US005143605A

United States Patent [19]

Masciarelli

[11] Patent Number: 5,143,605

[45] Date of Patent: Sep. 1, 1992

[54] MOBILE FLOATING SKIMMER

[76] Inventor: David Masciarelli, 392 Neponset St., Canton, Mass. 02021

[21] Appl. No.: 797,171

[22] Filed: Nov. 25, 1991

[51] Int. Cl.[5] ..... E04H 3/20

[52] U.S. Cl. ..... 210/169; 210/242.1; 210/416.2; 15/1.7; 4/490

[58] Field of Search ..... 210/169, 416.2, 242.1, 210/242.3, 923; 15/1.7; 4/490

[56] References Cited

U.S. PATENT DOCUMENTS

| | | | |
|---|---|---|---|
| 2,989,185 | 6/1961 | Lombardi | 210/776 |
| 3,186,550 | 6/1965 | Deduhn | 210/169 |
| 3,268,079 | 8/1966 | Sharrow, Jr. | 210/169 |
| 3,402,817 | 9/1968 | Dovel | 210/169 |
| 3,767,055 | 10/1973 | Flatland | 210/169 |
| 3,970,556 | 7/1976 | Gore | 210/242.1 |
| 4,032,449 | 6/1977 | De Visser et al. | 210/173 |
| 4,105,557 | 8/1978 | Weatherholt | 210/169 |
| 4,348,192 | 9/1982 | Pansini | 4/490 |
| 4,626,358 | 12/1986 | Fetsko | 210/242.3 |
| 4,746,424 | 5/1988 | Drew | 210/169 |
| 4,746,425 | 5/1988 | Stickler et al. | 210/175 |
| 4,781,827 | 11/1988 | Shields | 210/169 |
| 4,802,592 | 2/1989 | Wessels | 210/169 |
| 4,889,622 | 12/1989 | Newcombe-Bond | 210/169 |
| 4,988,437 | 1/1991 | Gefter et al. | 210/445 |

*Primary Examiner*—Peter Hruskoci
*Assistant Examiner*—Robert James Popovics
*Attorney, Agent, or Firm*—John P. McGonagle

[57] ABSTRACT

A mobile floating swimming pool skimmer having a flotation apparatus with a skimmer head assembly and a flexible conduit assembly interconnecting said skimmer head assembly with the swimming pool vacuum system. A leaf canister is incorporated into the flexible conduit assembly.

7 Claims, 6 Drawing Sheets

MOBILE FLOATING SKIMMER

BACKGROUND OF THE INVENTION

This invention relates to apparatus for removing floating debris from the surface of a pool of liquid, and more particularly to devices freely movable over the surface of the water of a swimming pool for removing floating leaves, bugs and other debris.

Leaves, bugs and other floating debris are commonly removed from swimming pools by "skimmers" built into the walls of the pool at the normal water level. Wave action in the pool, generated by people using the pool and/or by the wind, theoretically washes the floating leaves, etc., into troughs or openings in the wall of the pool, from whence they are drawn by a line connected to the suction side of the swimming pool pump. This system is generally not satisfactory, particularly where the wind tends to blow floating leaves and debris against the pool walls remote from the skimmer. Also, fluctuations in the water level adversely effect the operation of fixed skimmers, even to the point of becoming inoperable when the water level rises or falls two or more inches.

The prior art contains floating skimmer units which, although fixed in location, float in the water and hence remain at the same position relative to the pool surface, even though the skimmer intake unit moves up and down with changes in the water level. This overcomes the limitations inherent in fixed skimmers due to fluctuations in water level.

The prior art also contains devices which attempt to overcome the inherent limitations of skimmers which remain in the same location and are adversely effected by contrary wind directions. Among these types of devices are skimmers disclosed in U.S. Pat. Nos. 4,889,622; 4,105,557; and 2,989,185. These patents disclose skimmers which are comprised of various types of nets which are dragged about the surface of a pool to pickup floating leaves and debris. These devices tend to be ineffective as they are dependent upon direction of movement for effective operation. Their range and character of movement, as well as capacity for holding debris, are very limited.

In another variation of devices which attempt to overcome the inherent limitations of skimmers which remain in the same location and are adversely effected by contrary wind directions, the prior art contains floating skimmers of the self-propelled type. These types of devices typically use a drive means, such as a propeller (see U.S. Pat. No. 3,767,055) or hydraulic jets (see U.S. Pat. Nos. 4,746,424 and 4,348,192). Devices of this type are self-propelled and are able to move laterally on the surface of the pool in a manner eventually covering the entire pool surface. The drive means are typically battery driven or driven by water pressure. Although complicated and expensive, these types of devices, especially the ones with hydraulic jets, tend to push debris away. They also have a tendency to easily clog as small leaf gathering basket sizes are required in order to sustain motion. Where propeller-type propulsion means are used, it is not advisable to have swimmers in the water at the same time as the skimmer. Where hydraulic jet propulsion means are used, water under pressure and hoses therefore must be provided.

SUMMARY OF THE INVENTION

In view of the foregoing disadvantages inherent in the known types of devices now present in the prior art, the present invention provides an improved mobile floating skimmer. As such, the general purpose of the present invention, which will be described subsequently in greater detail, is to provide a new and improved mobile floating skimmer which collects leaves and floating debris in a manner eventually covering the entire pool surface without the limitations of prior art devices.

To attain this, the present invention connects the suction outlet from a swimming pool pump by means of a hose to a floating apparatus with a skimmer head. The hose is long enough to reach that part of the swimming pool furthest from the suction outlet. The floating apparatus drifts across the surface of the pool and allows the skimmer head to float at the surface of the water and hence remain at the same position relative to the pool surface. The skimmer head draws in floating leaves and debris as it drifts across the surface of the swimming pool. The invention will tend to drift in the direction of the wind toward the areas where the wind tends to blow and concentrate floating leaves and other debris.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
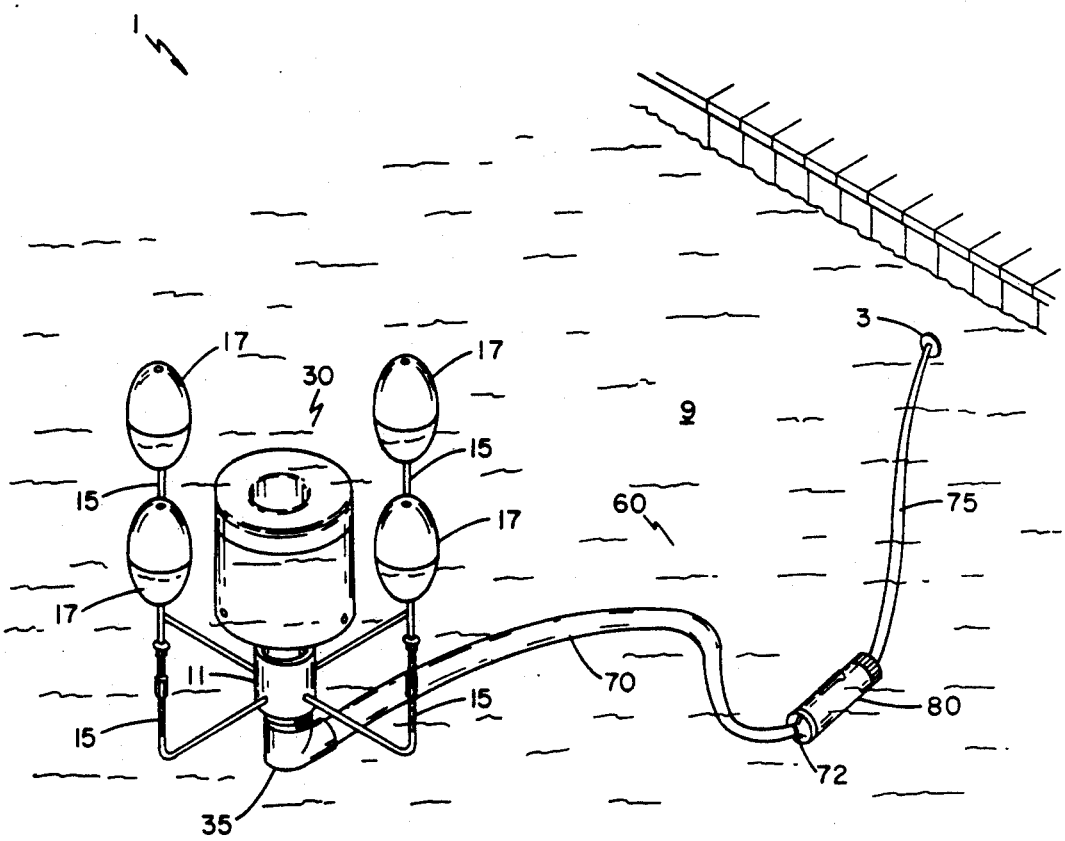
FIG. 1 is a perspective view of a mobile floating skimmer made in accordance with the present invention and shown in operative position in the water of a swimming pool.
Figure 2:
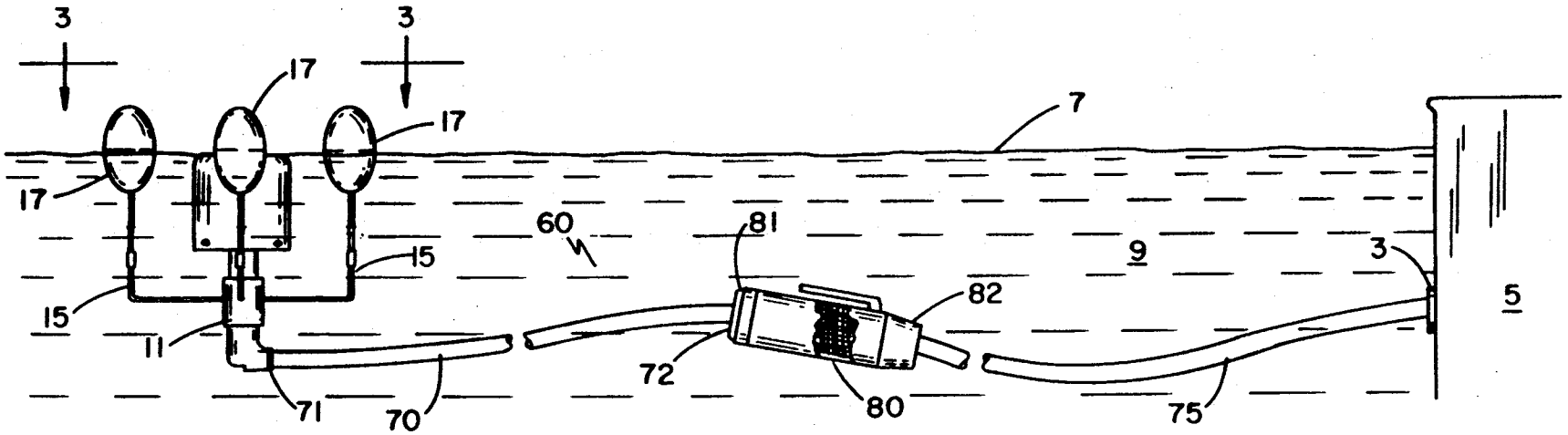
FIG. 2 is a side view of the apparatus of FIG. 1.
Figure 3:
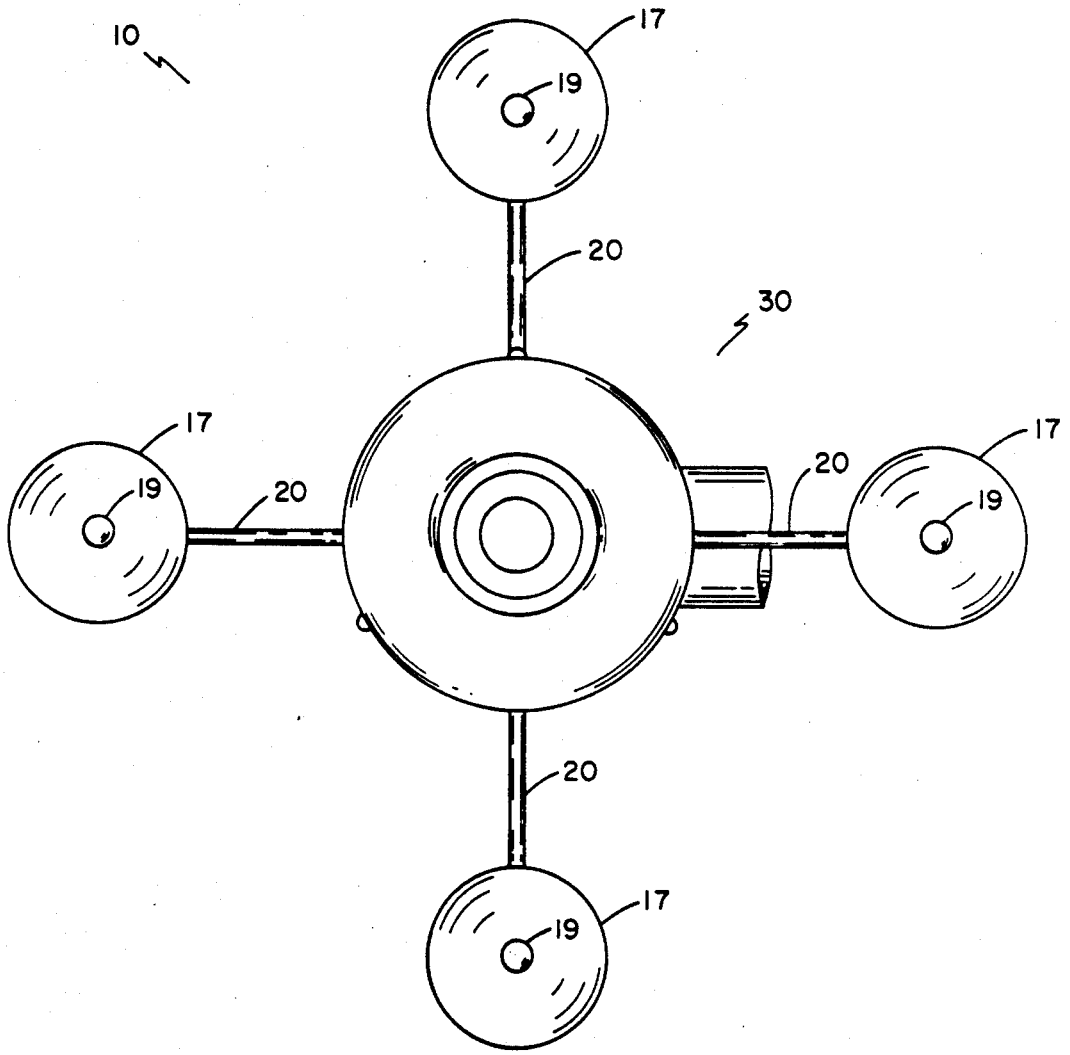
FIG. 3 is a top plan view of the apparatus of FIG. 2 along the line 3—3.
Figure 4:
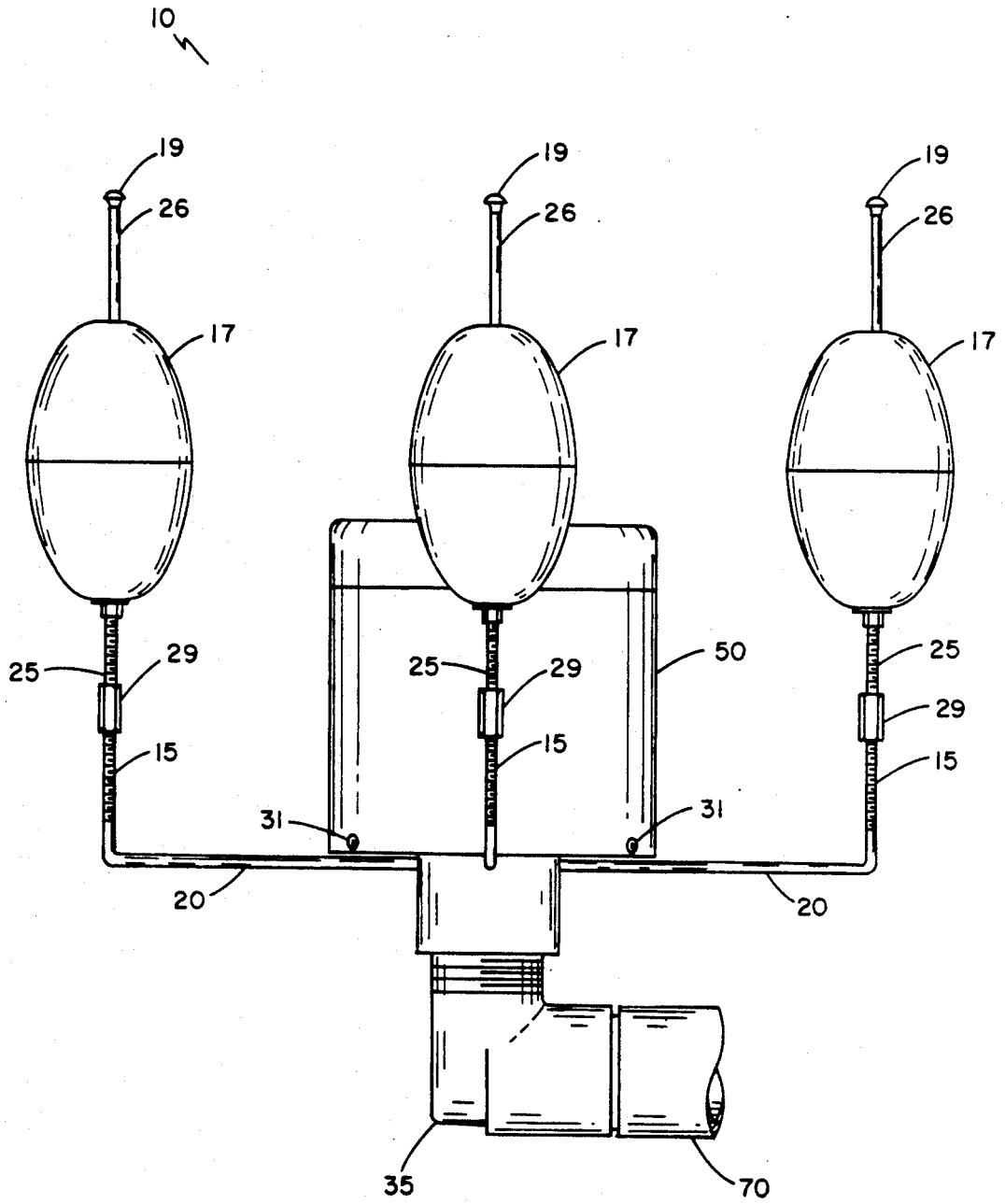
FIG. 4 is a side elevational of the apparatus of FIG. 3.

Referring to the drawings in detail, particularly FIGS. 1 and 2, wherein like elements are indicated by like numerals, there is shown an embodiment of the invention 1 incorporating a mobile floating skimmer. The invention 1 is comprised of a flotation apparatus 10 with a skimmer head assembly 30 and an interconnecting flexible conduit assembly 60 connected to the usual vacuum cleaner fitting, i.e., swimming pool's suction pump outlet 3, found in the wall 5 of the pool.

The flotation apparatus skimmer head assembly 30 contains a vertical cylindrical pipe section 40 with an annular bracket 11 radially attached thereto and surrounding a portion thereof. Laterally and radially extending from the bracket 11 are four equispaced, L-shaped elements 15, each having a horizontal section 20 and an upwardly extending vertical section 25. One end 21 of each horizontal section 20 attaches to the bracket 11 and the other end 22 of the horizontal section 20 forms an L-shaped elbow with the vertical section 25. The upper most portions of the vertical sections 25 of each L-shaped element 15 each have a flotation bulb slidably 17 attached thereto. The uppermost end 26 of each vertical section 25 terminates in a stop flange 19 which defines the maximum upward movement of each flotation bulb 17. Adjustment means 29 are provided on each vertical section 25 for changes in the length of the vertical sections 25.

The vertical cylindrical pipe section 40 has two ends, a top end 41 and a bottom end 42. The top end 41 has an external annular flange 43 attached thereto. The bottom end 42 of the vertical pipe 40 terminates in a ninety degree coupling elbow 35 to which one end 71 of a hose 70 is connected. In optional embodiments, the elbow 35 may be replaced with a swivel cuff, or even a straight coupler.

The skimmer head assembly 30 also contains a hollow, vertical outer cylinder 50 with open ends 51, 52. The outer cylinder's inner diameter is slightly greater than the outer diameter of the pipe section annular flange 43. The cylinder 50 has an upper section 53 and a lower section 54. The lower cylinder section 54 has a plurality of stop screws 31 inserted through the cylinder wall 55 and extending partly into the cylinder interior 56. The stop screws 31 all lie in the same radial plane. The cylinder 50 is positioned about the vertical pipe radial flange 43 so that the cylinder stop screws 31 are positioned beneath the radial flange 43. The upper portion 53 of the cylinder interior 56 has a radial, flotation element 57 attached therein with a circular central opening 58 having a diameter approximately equal to the outer diameter of the pipe section 40.

The suction hose assembly 60 is comprised of two hose lengths 70 and 75. As stated above one end 71 of the first hose 70 connects to the coupling elbow 35 at the bottom end 42 of the flotation apparatus vertical pipe section 40. The other end 72 of the first hose 70 is connected to the top 81 of a leaf canister 82, preferably a large capacity one such as the Large Capacity Leaf Canister distributed by Arneson Products, Inc. A second hose 75 interconnects the bottom 82 of the leaf canister 80 to the swimming pool suction line outlet 3 located in one of the pool walls 5.

Figure 6:
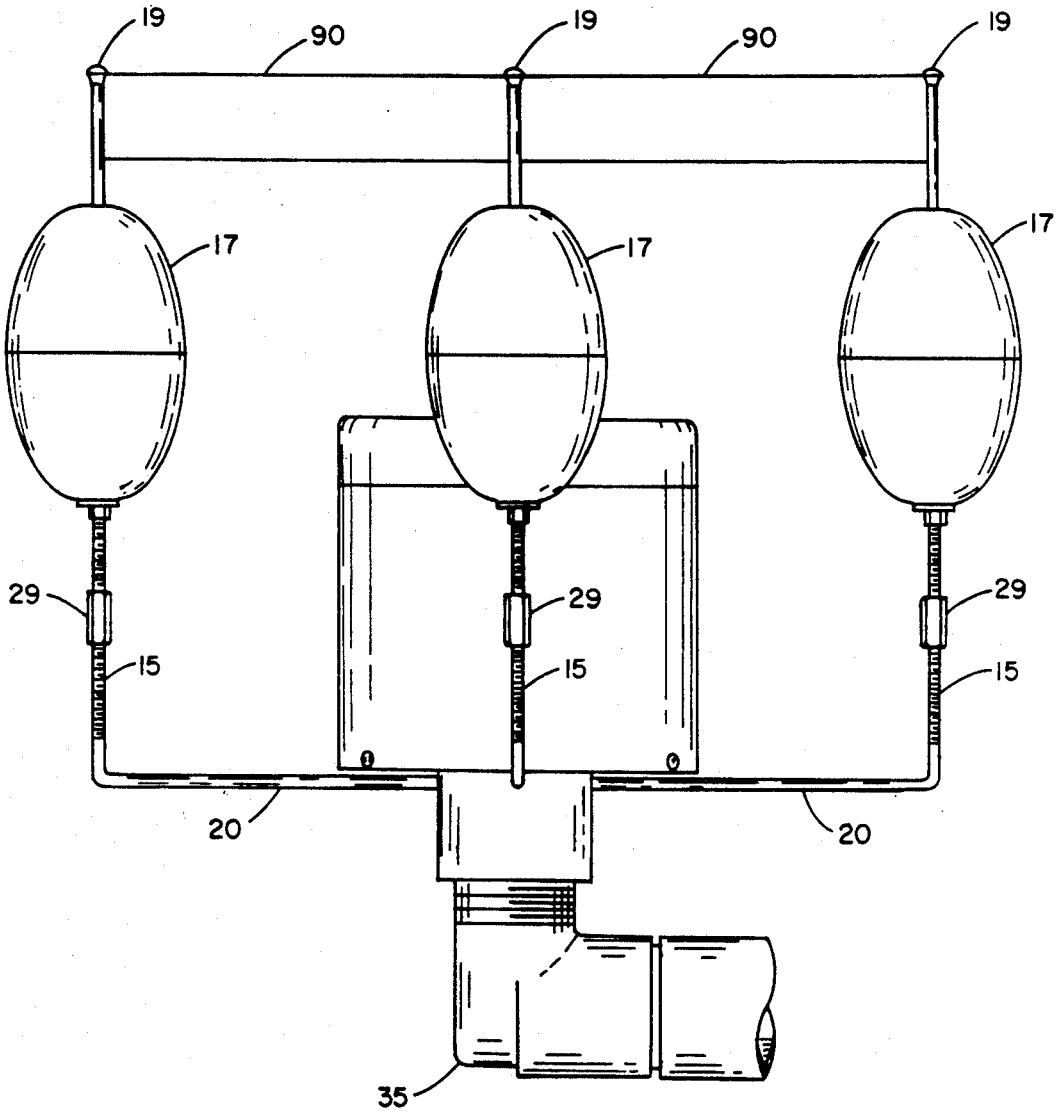
FIG. 6 is a side elevational view of an alternate embodiment of the invention.

In another embodiment shown in FIG. 6, small plastic "sails" 90 are attached to and interconnect the upper portions of the vertical sections 25. This provides additional responsiveness to breezes and increases the movement of the flotation apparatus 10 about the pool. Alternatively, the plastic "sails" might be comprised of thin plastic sheathing which connect one float bulb to another.

OPERATION

Figure 5:
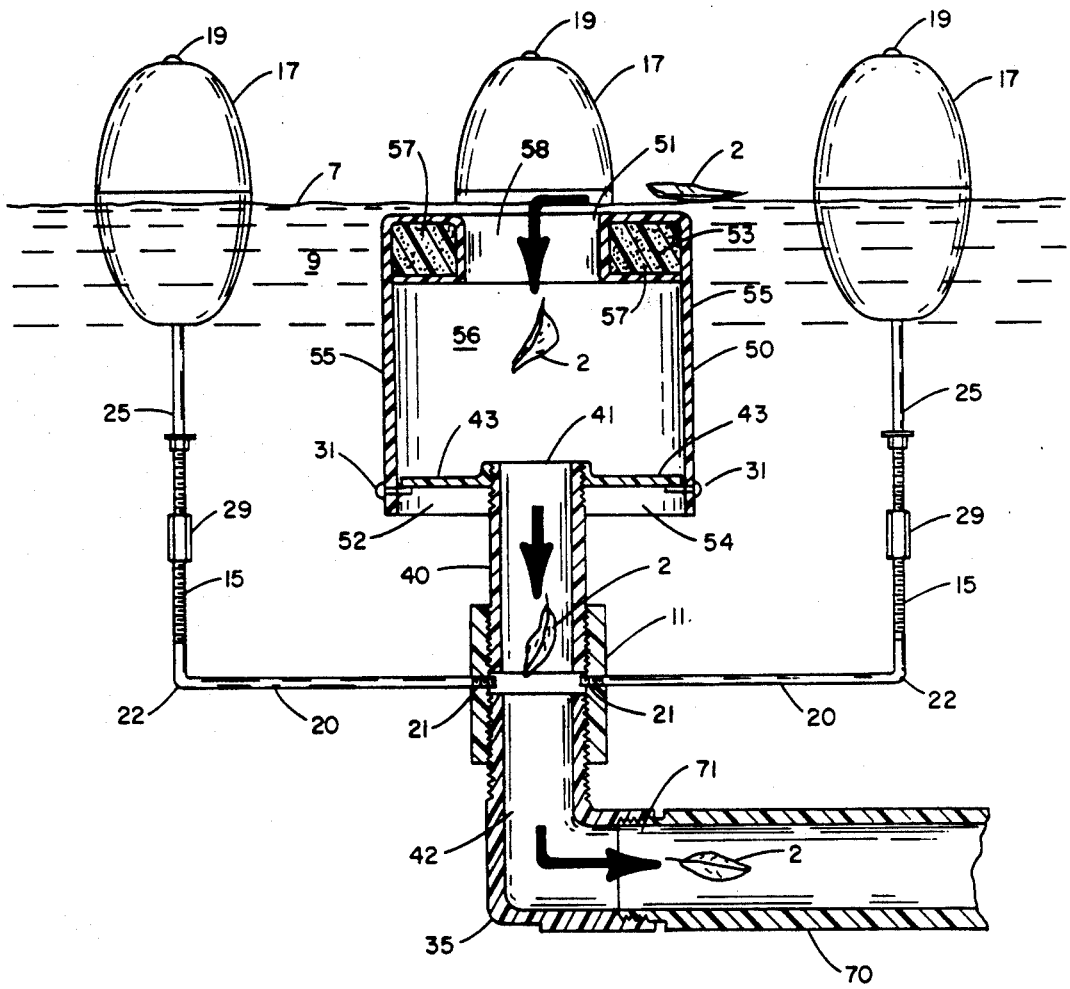
FIG. 5 is a side elevational view, partly in section, of the apparatus of FIG. 4.

The operation of the invention may be best understood in conjunction with a review of FIGS. 2 and 5. The mobile floating skimmer 1 drifts with the breeze and water motion within the pool, and will tend to move towards the areas where the heaviest concentrations of leaves, bugs and debris also move to. The outer cylinder 50 floats so that its upper end 51 tends to "skim" the surface 7 of the water 9. Leaves 2, bugs and other debris will be drawn through the central opening 58 of the cylinder upper section 53 into the cylinder interior 56 and then sucked into the top end 41 of the vertical pipe 40. The leaves 2, bugs and debris will move through the vertical pipe 40, through the coupling elbow 35, and into the first hose 70. The leaves 2, bugs and debris then move into the leaf canister 80 where they are trapped. The design of the leaf canister 80 allows the skimmer 1 to maintain suction from the pool pump (not shown) until the leaf canister 80 has trapped approximately one-half bushel of leaves, bugs and debris. The leaf canister 80 is then drawn to the surface, where it is emptied, reassembled and placed back into the pool. The invention 1 may be left on and running all the time that the pool's suction pump is running. Since the invention 1 is not self-propelled, there is little hazard to swimmers.

It is understood that the above-described embodiment is merely illustrative of the application. Other embodiments may be readily devised by those skilled in the art which will embody the principles of the invention and fall within the spirit and scope thereof.

I claim:

1. A mobile floating skimmer for use in a swimming pool having a filter pump assembly and a vacuum fitting, comprising:

a flotation apparatus with a skimmer head assembly, comprising:

a vertical cylindrical pipe section with an annular bracket radially attached thereto and surrounding a portion thereof;

a plurality of L-shaped elements laterally and radially extending from said bracket, each L-shaped element having a horizontal section with two ends and an upwardly extending vertical section with two ends, wherein one end of each horizontal section is attached to the bracket and the other end of the horizontal section forms an L-shaped elbow with one end of the vertical section;

a plurality of flotation bulbs, one for each L-shaped element, slidably attached to the vertical sections of each L-shaped element;

wherein the uppermost end of each vertical section terminates in a stop flange which defines the maximum upward movement of each flotation bulb; and a flexible conduit assembly interconnecting said skimmer head assembly with said vacuum fitting, said flexible conduit assembly having a first flexible conduit interconnecting said skimmer head assembly with a leaf canister, and a second flexible conduit interconnecting said leaf canister with said vacuum fitting.

2. A mobile floating skimmer as described in claim 1 wherein:

each vertical section contains adjustment means for changing the length of each vertical section.

3. A mobile floating skimmer as described in claim 2 wherein said skimmer head assembly is comprised of:

said vertical cylindrical pipe section having two ends, a top end and a bottom end, wherein said top end has an external radial flange attached thereto and said bottom end terminates in a coupling elbow to which on end of said first flexible conduit is connected; and a hollow, vertical outer cylinder with open ends having an inner diameter slightly greater than the outer diameter of the pipe section radial flange, and having an upper section and a lower section, the lower section having a plurality of stop screws inserted through the cylinder wall and extending partly into the cylinder interior, said stop screws all being in the same radial plane, wherein said cylinder is positioned about the vertical pipe radial flange so that the cylinder stop screws are positioned beneath the radial flange.

4. A mobile floating skimmer as described in claim 3 wherein:

said upper section of the cylinder interior has a radial, flotation element attached therein with a circular central opening.

5. A mobile floating skimmer as described in claim 4 wherein:

said coupling elbow is comprised of a swivel cuff.

6. A mobile floating skimmer as described in claim 5 further comprising:

thin sheets of material attached to and interconnecting the upper portions of the L-shaped elements: vertical sections.

7. A mobile floating skimmer as described in claim 6 further comprising:

sheathing which connect one float bulb to another.

* * * * *